US012723398B1

(12) United States Patent
Caratozzolo

(10) Patent No.: US 12,723,398 B1
(45) Date of Patent: Sep. 1, 2026

(54) SELF-ERECTING EMERGENCY SHELTER

(71) Applicant: Ariel Caratozzolo, Miami, FL (US)

(72) Inventor: Ariel Caratozzolo, Miami, FL (US)

( * ) Notice: Subject to any disclaimer, the term of this patent is extended or adjusted under 35 U.S.C. 154(b) by 424 days.

(21) Appl. No.: 18/215,541

(22) Filed: Jun. 28, 2023

(51) Int. Cl.
*E04B 1/344* (2006.01)
*E04B 1/343* (2006.01)

(52) U.S. Cl.
CPC ..... *E04B 1/3445* (2013.01); *E04B 1/34352* (2013.01); *E04B 1/34363* (2013.01); *E04B 1/34384* (2013.01)

(58) Field of Classification Search
CPC ..... E04B 1/355; E04B 1/3445; E04B 1/343; E04B 1/34384; E04B 1/34352; E04B 1/34363; E04B 1/3538
See application file for complete search history.

(56) References Cited

U.S. PATENT DOCUMENTS 4,027,912 A * 6/1977 Pacca ..... B60P 3/38 296/160
4,417,426 A * 11/1983 Meng ..... E04B 1/34352 52/167.3
8,650,806 B1 * 2/2014 Condie ..... E04H 1/1277 52/79.5
8,881,470 B1 * 11/2014 Lass ..... E04H 1/12 52/79.5
8,991,105 B2 * 3/2015 Harvey ..... E04B 1/3445 52/68
2005/0044804 A1 * 3/2005 Bin ..... E04B 1/3445 52/79.5
2005/0210764 A1 * 9/2005 Foucher ..... E04B 1/3445 52/79.5
2007/0163474 A1 * 7/2007 Truksa ..... A47B 43/00 108/106
2008/0142059 A1 * 6/2008 Bonebrake ..... E04B 1/3444 135/88.1
2010/0018130 A1 * 1/2010 Lopez ..... E04B 1/3445 16/385
2014/0157685 A1 * 6/2014 Fagan ..... E04H 1/1205 52/79.5
2018/0313074 A1 * 11/2018 Brown ..... E04H 9/10

* cited by examiner

*Primary Examiner* — Christine T Cajilig
(74) *Attorney, Agent, or Firm* — Sanchelima & Associates, P.A.; Christian Sanchelima; Jesus Sanchelima

(57) ABSTRACT

A self-erecting emergency shelter including a base assembly, a wall assembly, a roof assembly and a self-erecting assembly. The base assembly includes a base and height-adjustable legs. The base supports the wall assembly. The wall assembly includes walls pivotally attached to the base. The roof assembly includes a roof pivotally attached to the walls. The self-erecting assembly includes a plurality of gas springs. The gas springs are consecutively actuated to take the wall assembly and the roof assembly from an retracted configuration to an expanded configuration. In the expanded configuration the wall assembly and the roof assembly form an emergency shelter. In the retracted configuration the walls and the roof are perpendicularly placed over the base.

16 Claims, 19 Drawing Sheets

SELF-ERECTING EMERGENCY SHELTER

BACKGROUND OF THE INVENTION

1. Field of the Invention

The present invention relates to a self-erecting emergency shelter and, more particularly, to a self-erecting emergency shelter that can be automatically assembled through a plurality of gas springs which are actuated to lift the walls to an erected position.

2. Description of the Related Art

Several designs for emergency shelters have been designed in the past. None of them, however, include self-introducing clips which are used to block the walls in an erected position after lifting the walls of the self-erecting emergency shelter.

Applicant believes that a related reference corresponds to U.S. Pat. No. 4,027,912 issued for collapsible roof-top camper. Applicant believes that another related reference corresponds to U.S. patent No. US 20050044804A1 issued for a foldable house and container assembly. None of these references, however, teach of a self-erecting emergency shelter having a plurality of gas springs which are actuated by removing a cotter pin, where locking members are self-inserted to secure the self-erecting emergency in an expanded configuration, where walls of the emergency shelter are release to be erected in a predetermined order.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a self-erecting emergency shelter that includes walls made of having a frame wall made of rods covered by rectangular panels providing a light-weight structure.

It is another object of this invention to provide a self-erecting emergency shelter that includes a front and rear wall having a predetermined height and a triangular top thereby defining an open gable roof which prevents accumulation of debris and snow thereon.

It is another object of this invention to provide a self-erecting emergency shelter that includes a plurality of adjustable legs which allows to level the self-erecting emergency shelter and having it a predetermined separation with the ground.

It is another object of this invention to provide a self-erecting emergency shelter that is portable and has such a dimension that facilitates transportation thereof in container ships, tow trucks, and so on, allowing quick and efficient access in emergency situations.

It is another object of this invention to provide a self-erecting emergency shelter which can be manually taken back to a retracted configuration, where the self-erecting emergency shelter has a rectangular shape in the retracted configuration, allowing to be stacked therebetween.

It is another object of this invention to provide a self-erecting emergency shelter that includes a releasing mechanism which allows a quick self-erecting of the present invention.

It is still another object of the present invention to provide a self-erecting emergency shelter that does not require any additional hardware nor operative manual for installation thereof since it is self-erected and includes indicia in one of the walls to show how it is erected.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
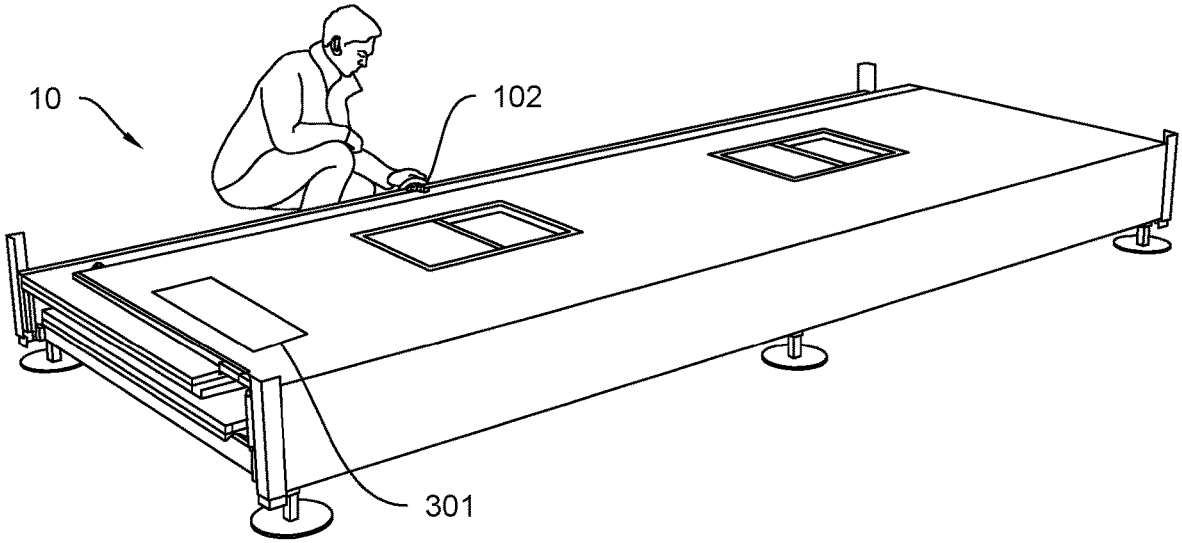
FIG. 1 represents an isometric operational view of the present invention 10 being released to an expanded configuration by pulling from the releasing member 102.
Figure 1A:
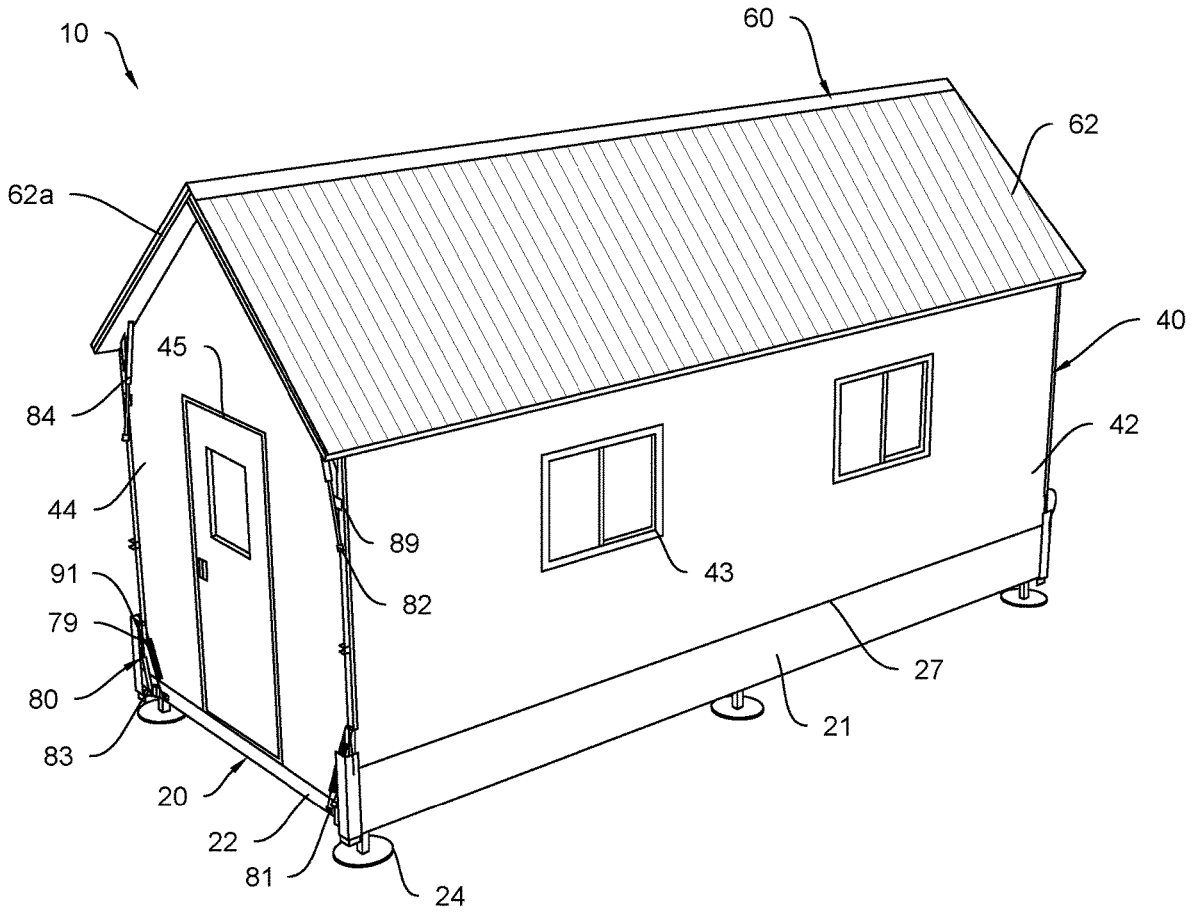
FIG. 1A depicts an isometric view of the present invention 10 in an expanded configuration.

Referring now to the drawings, where the present invention is generally referred to with numeral 10, it can be observed that it basically includes a base assembly 20, a wall assembly 40, a frame wall assembly 50, a roof assembly 60 and a self-erecting assembly 80 It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The base assembly 20 may include a base 22, piano hinges 27, a bottom frame 29 and legs 24. The base 22 may be a rectangular base supported by legs 24. The base 22 may be the bottom frame 29 enclosed at top and bottom by floor plates. In a preferred embodiment the floor plates of the bottom frame 29 may be made of plywood with a polyvinyl chloride coat. It also may be suitable for the floor plates of the bottom frame 29 to be made of fiberglass, aluminum, or any other suitable material. The bottom frame 29 may have structural rectangular pipes vertically and horizontally disposed defining a rectangular frame. In a preferred embodiment the bottom frame 29 is made of steel or aluminum. It also may be suitable for the bottom frame 29 to be made of copper, fiberglass, polyvinyl chloride, or any other suitable material.

Figure 4:
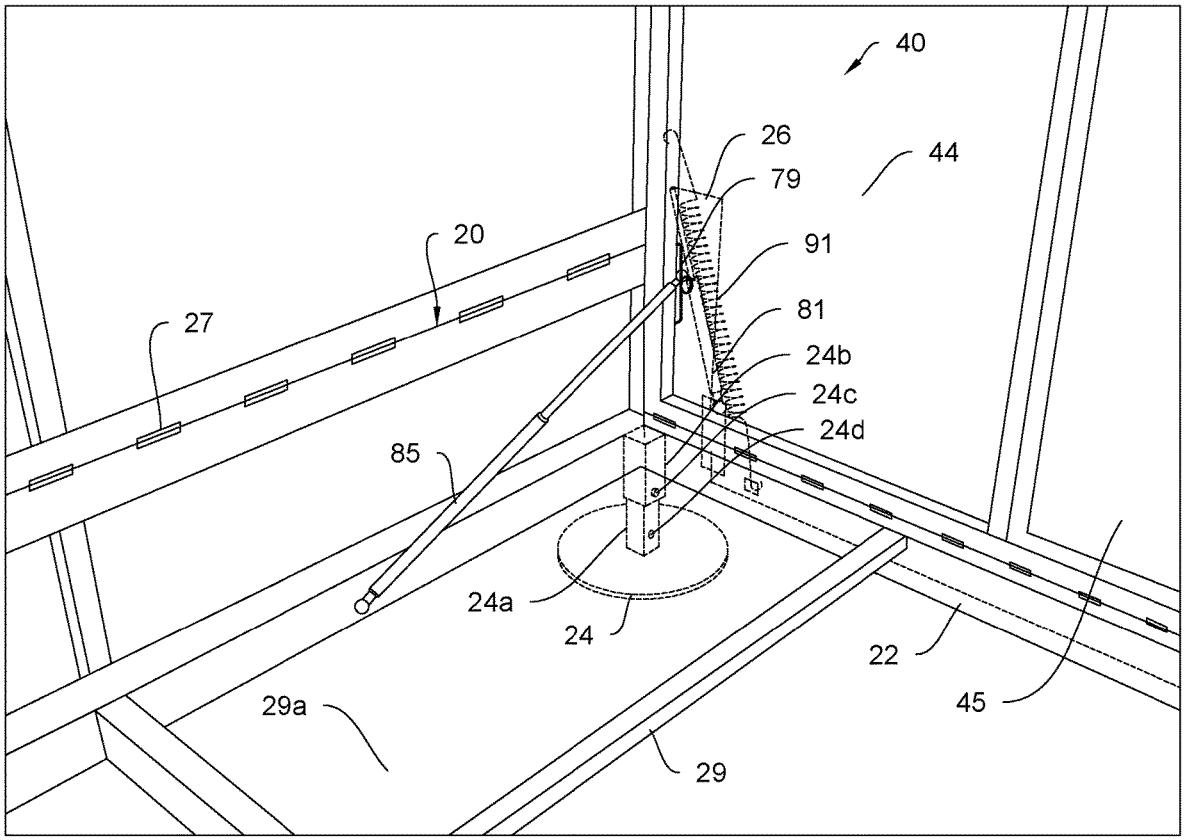
FIG. 4 illustrates an enlarged see-through view of the right front corner showing a first gas spring 81 and fifth gas spring 85.
Figure 5:
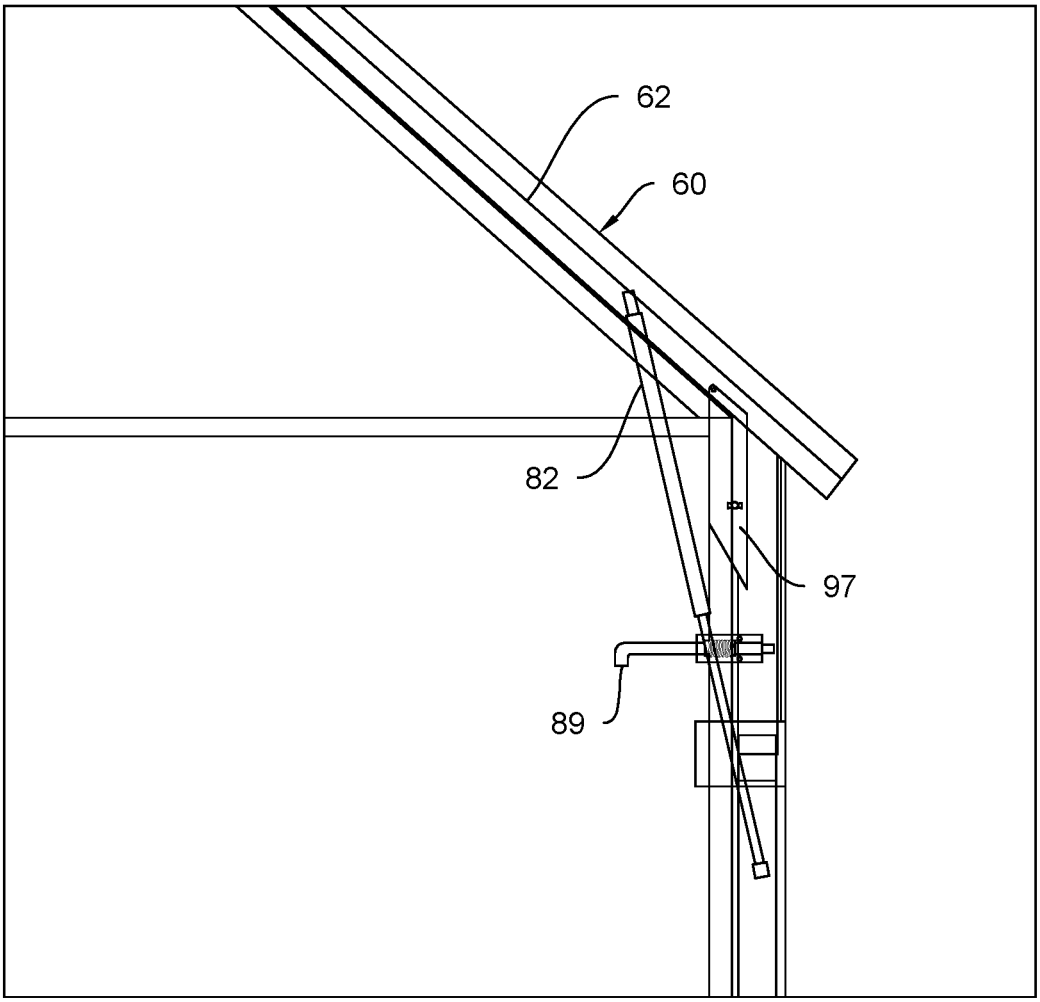
FIG. 5 is a representation of an enlarged front see-through view of the front frame wall 44 showing a second gas spring 82.
Figure 6:
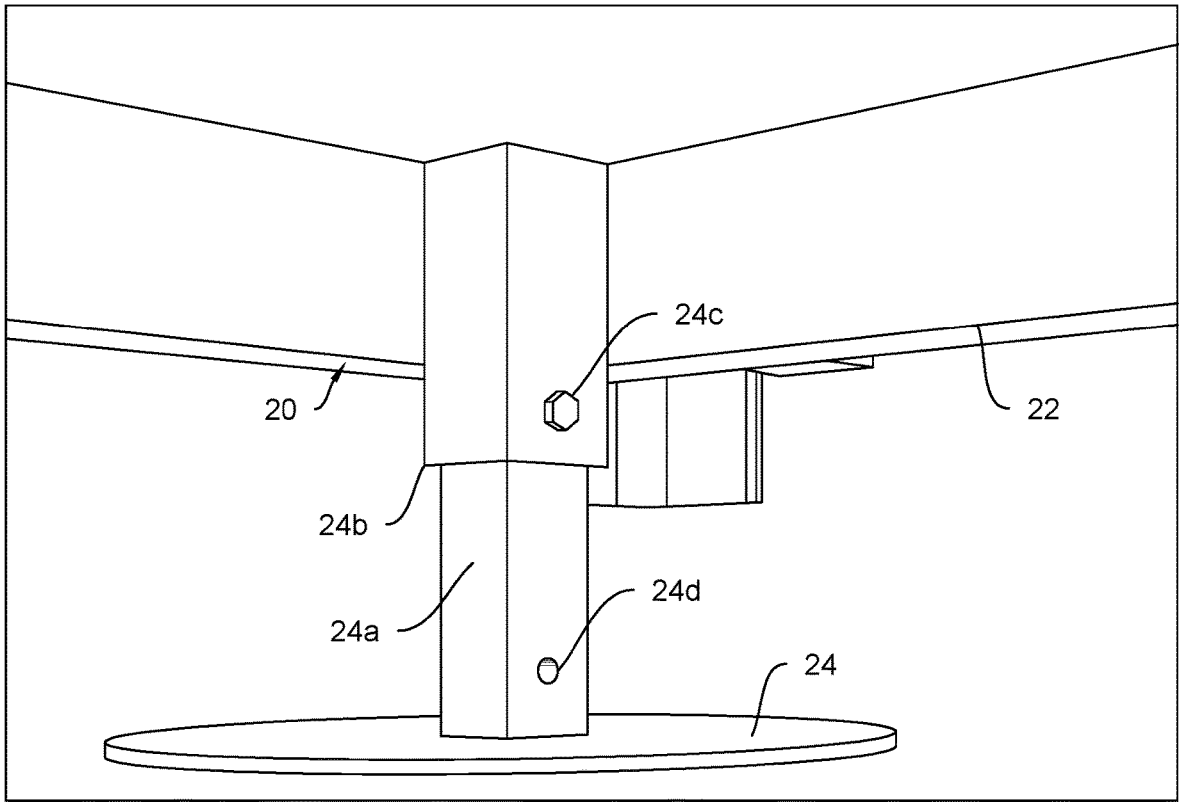
FIG. 6 is an enlarged view of one of the adjustable legs 24.

The legs 24 may be attached perpendicularly below to the four corners of the bottommost end of the base 22. As best illustrated in FIG. 4 the legs 24 may include a bottom portion 24*a*, a top portion 24*b*, and holes 24*c*. The bottom portion 24 may include a rectangular element having a circular flat element in a bottommost end thereof. The top portion 24*b* and the bottom portion 24*a* may include holes 24*c*. The top portion 24*b* may be a receiver element having a rectangular shape. The top portion 24*b* may be hollow. The top portion 24*b* may receive the bottom portion 24*a* therein. The bottom portion 24*a* may be adjustable fixed within the top portion 24*b* by coupling the holes 24*c* of the bottom portion 24*a*, and the holes of the top portion 24*b* together and introducing a fastener therethrough.

The base 22 may further include lateral protrusions extending from sidewalls thereof having the piano hinges 27 in uppermost ends of the lateral protrusions. The piano hinges 27 may connect the base assembly 20 with the wall assembly 40.

The wall assembly 40 may include a right wall 42, a left wall 42*a*, a rear wall 44*a* and a front wall 44. The front wall 44 may include a door 45. The front wall 44 may substantially have a rectangular shape with a triangular top end. The front wall 45 may include a door 45 on a central portion thereof. The right wall 42 may have a rectangular shape. The right wall 42 may be diametrically opposite to the left wall 42*a*. The right wall 42 may include at least one window 43. It may be suitable for the right wall 42, the left wall 42*a*, the front wall 44 and the rear wall 44*a* to include at least one window 43. The left wall 42*a* may be a mirror image of the right wall 42. The rear wall 44*a* may be a mirror image of the front wall 44.

Figure 17:
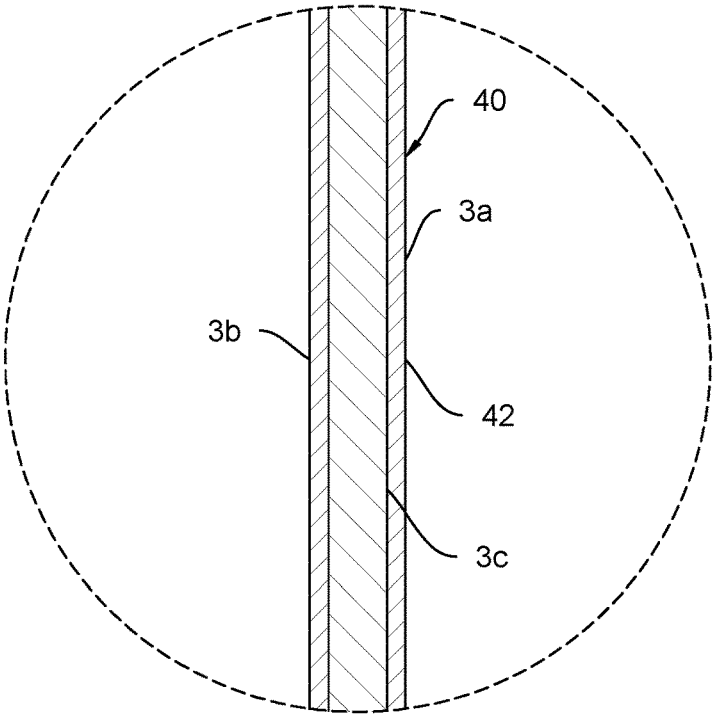
FIG. 17 is a representation of an enlarged cross sectional view from C to C of FIG. 14 showing insulation 3*c*.

As best illustrated in FIG. 17 each of the rear wall 44, the front wall 44, the right wall 42 and the left wall 42*a* may include an exterior layer 3*a*, insulation 3*c* and an interior layer 3*b*. The exterior layer 3*a* may preferably be made of fiberglass. The interior layer 3*b* may preferably be made of plywood. It should be understood that different materials such as aluminum, polyvinyl chloride, or any other material may be suitable to be used for the interior layer 3*b* and the exterior layer 3*a*. The interior layer 3*b* and the exterior layer 3*a* may enclose insulation 3*c*. In a preferred embodiment, insulation 3*c* may be made of expanded polystyrene. It also may be suitable for the insulation 3*c* to be made of fiberglass, mineral wool, cellulose, perlite, or any other suitable material. The insulation 3*c* may be held within rectangular openings defined by the frame assembly 50. The frame assembly 50 may be enclosed by the exterior layer 3*a* and the interior layer 3*b*.

Figure 3:
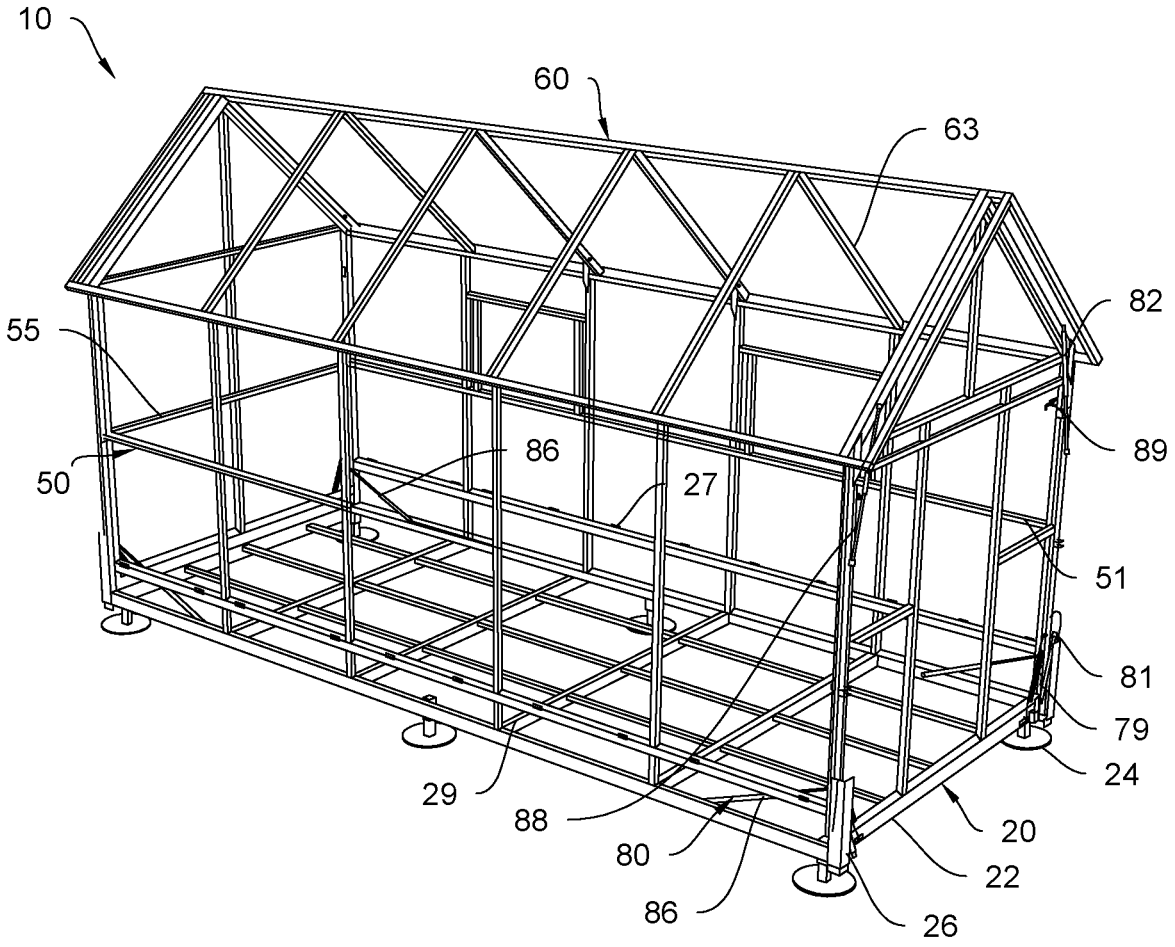
FIG. 3 shows an isometric view of the present invention 10 having no wall assembly 40.

As best illustrated in FIG. 3 the frame assembly 50 may include a rear frame 55, side frames 51, a front frame 52, and a top-front frame 53. The rear frame 55, the side frames 51, the front frame 52 and the top-front frame 53 may be made of structural rectangular pipes vertically and horizontally disposed defining frames having the aforementioned rectangular openings. In a preferred embodiment the structural rectangular pipes may be made of iron, aluminum, stainless steel, or a combination thereof.

The side frames 51 may have a rectangular shape. The side frames 51 may include a left side frame enclosed within the left wall 42*a* and a right side frame enclosed within the right wall 42. The side frames 51 may have a greater length that a width thereof. The side frames 51 may be pivotally connected to the base 22 by means of the piano hinges 27. The front frame 52 may be pivotally connected to a front side of base 22 through piano hinges 27. The rear frame 55 may be pivotally connected to a rear side of the base 22 through piano hinges 27. The front frame 52 and the top front frame 53 may be enclosed within the front wall 44. The front frame 52 may include a right portion, a central portion and a left portion. The right portion and the left portion of the front frame 52 may define two rectangular openings and the central portion may define a central rectangular opening. The front frame 52 may have a rectangular shape and may have the top front frame 53 in an uppermost end thereof. The top front frame 53 may define a triangular shape.

The rear frame 55 may have a rectangular shape with a triangular top end. The rear frame 55 may be enclosed within the rear wall 44*a*. It should be understood that the frame assembly may provide structural support to the wall assembly 40 while providing a light weight structure.

The roof assembly 60 may include a right-side roof 62, a left-side roof 62*a*, hinges 67, and top frames 63. Top frames 63 may have a rectangular shape. The top frames 63 may have a greater length than a width thereof. The top frames 63 may include a top-right frame enclosed within the right side roof 62 and a top-left frame enclosed within the left side roof 62*a*. The top frames 63 may be made of structural rectangular pipes vertically and horizontally disposed defining frames having the aforementioned rectangular openings. In a preferred embodiment the structural rectangular pipes may be made of iron or aluminum. The right-side roof 62 and the left-side roof 62 may be diagonally disposed on a top end of the wall assembly 40. The roof assembly 60 may define an open gable roof. The left-side roof 62*a* may be pivotally connected to the left wall 42*a* by means of hinges 67. The right-side roof 62 may be pivotally connected to the right wall 42 by means of hinges 67. The right-side roof 62 and the left-side roof 62*a* may be made of an exterior wall made of a sinusoidal sheet of pre-painted steel and an interior wall of smooth injected polyurethane enclosing the top frames 63 and filled with an insulation material.

The present invention 10 includes a retracted configuration and an expanded configuration. It should be understood that in the expanded configuration the wall assembly 40, the base assembly 20 and the roof assembly 60 may define an emergency shelter having sidewalls, roof and base tightly coupled preventing any leaking therewithin.

Figure 2:
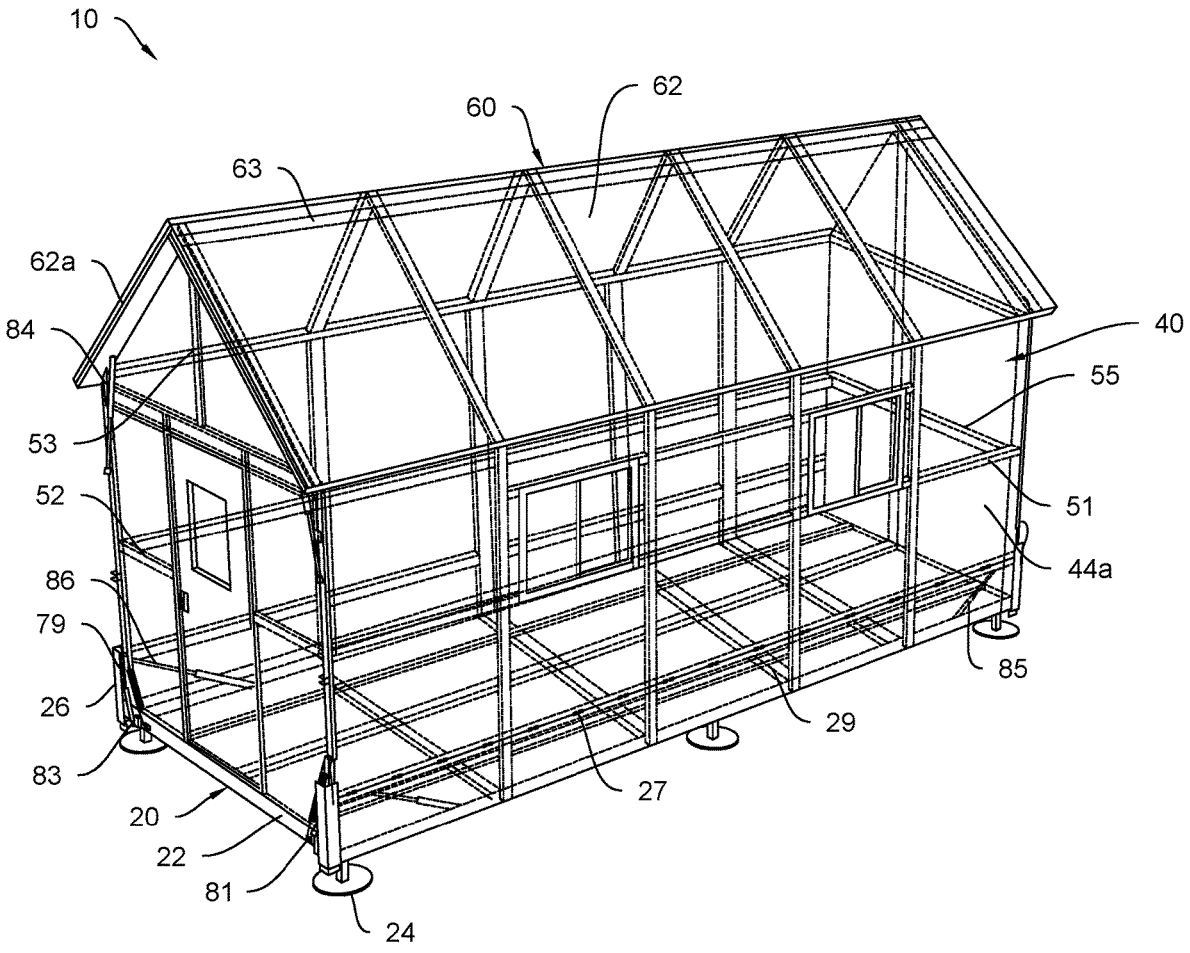
FIG. 2 is an illustration of a see-through view of the present invention 10.
Figure 18:
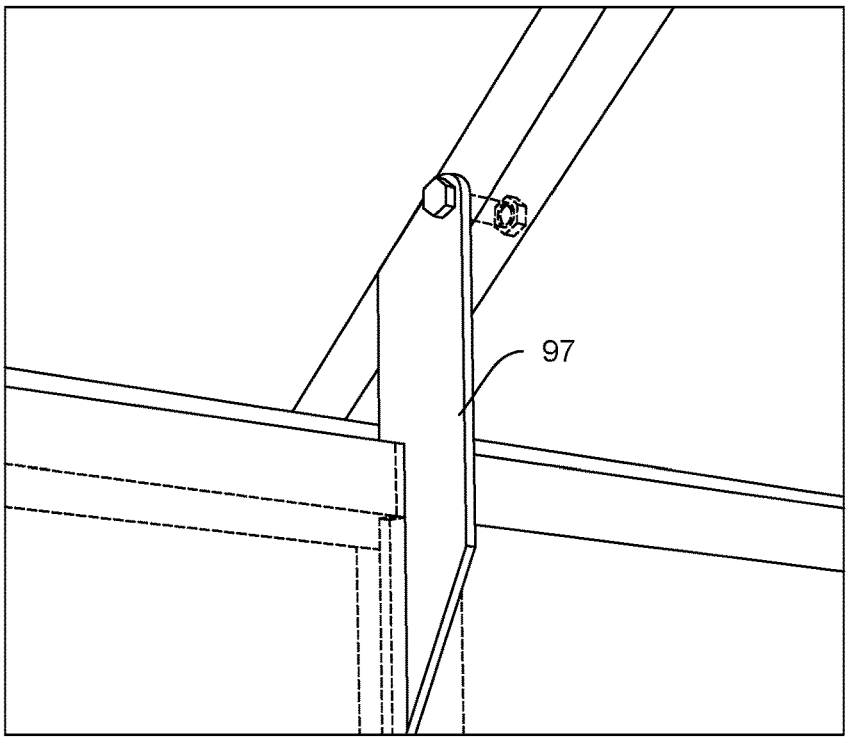
FIG. 18 is an enlarged view of one of the pivoting members 97.
Figure 19:
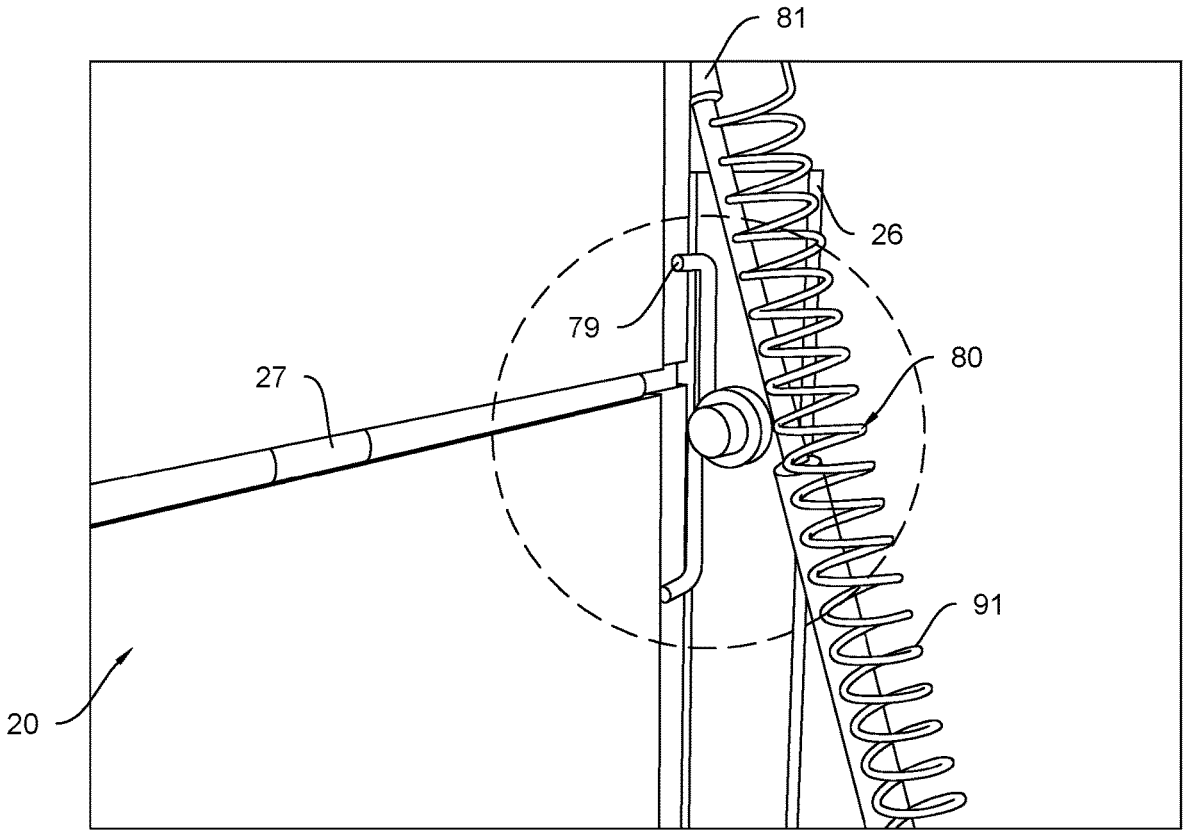
FIG. 19 is an enlarged view of one of the erecting members 79.

Referring now to FIG. 4, FIG. 3 and FIG. 2 it can be observed that the self-erecting assembly 80 may include first gas springs 81, second gas springs 82, third gas springs 83, fourth gas springs 84, fifth gas springs 85, sixth gas springs 86, securing members 99, springs 91, actuation members 95, a receiving member 99*a*, a releasing member 102, pivoting members 97, attaching members 12, erecting members 79, and spring loaded latches 89. The first gas springs 81 may include two gas spring connecting a right portion of the base 22 with the front and rear end of the right wall 42. The second gas springs 82 may be two gas springs connecting a top portion of the right wall 42 with a bottom portion of the right-side roof 62. The third springs 83 may be two gas springs connecting a left portion of the base 22 with a bottom portion of the left wall 42*a*. The fourth gas springs 84 may be two gas springs connecting a top portion of the left wall 42*a* with a bottom portion of the left-side roof 62*a*. The sixth gas springs 86 may be two gas springs connecting a front portion of the base 22 with a bottom-rear portion of the front wall 44. The fifth gas springs 85 may be two gas springs connecting a rear portion of the base 22 with a bottom portion of the rear wall 44*a*. It should be understood that additional gas springs may be used to lift the aforementioned walls of the present invention 10. As best illustrated in FIG. 18 the pivoting members 97 may pivotally connect the top frames 63 with the right wall 42 and the left wall 42*a*. In a preferred embodiment the pivoting member 97 may include self releasing fasteners which may be manually fixed or unfixed to retract or expand the roof assembly 60.

Figure 9:
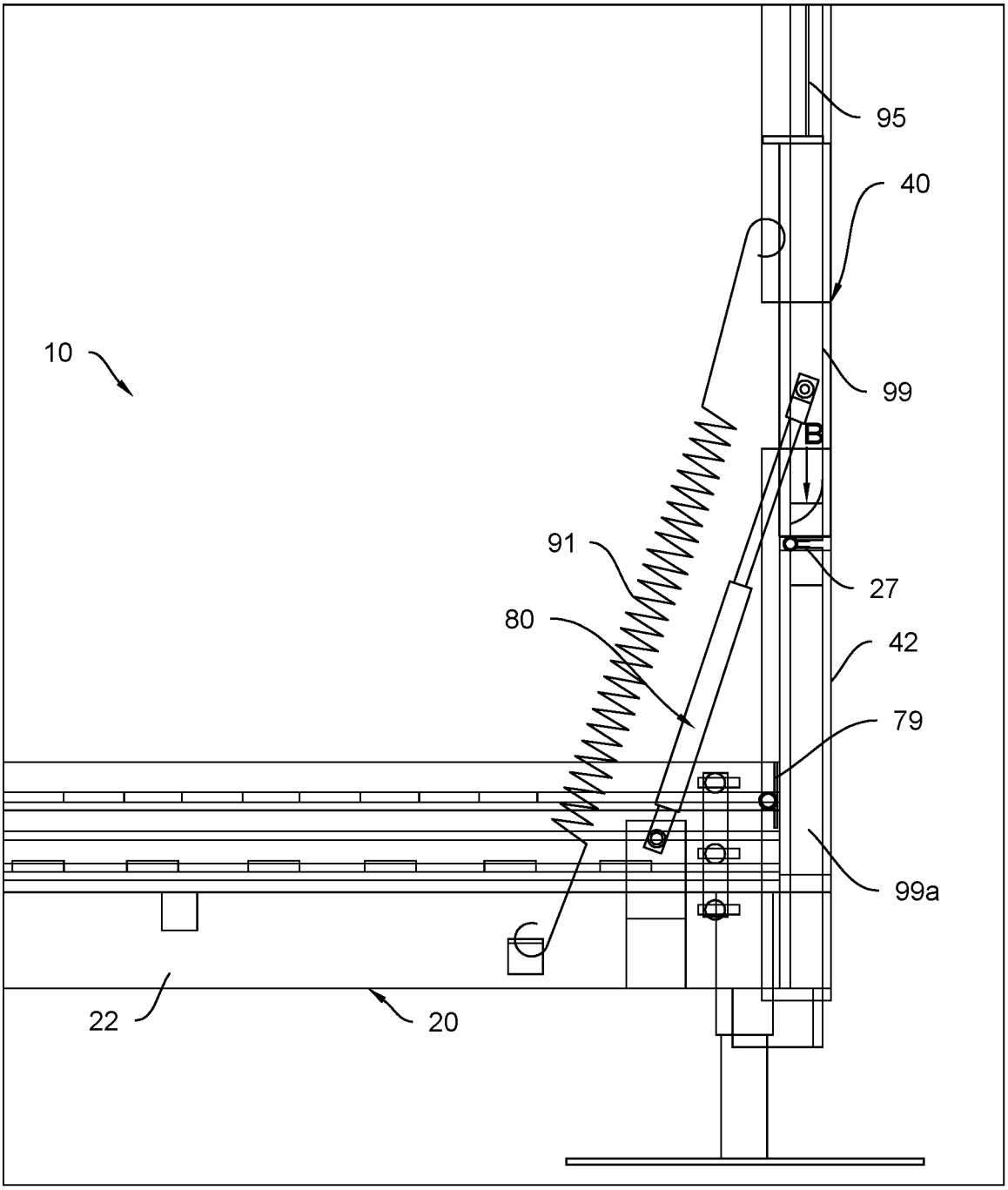
FIG. 9 depicts an enlarged front see-through view of the right-bottom portion of the present invention 10 showing a securing member 99 being pushed to secure the right wall 42*a* in an expanded configuration.
Figure 10:
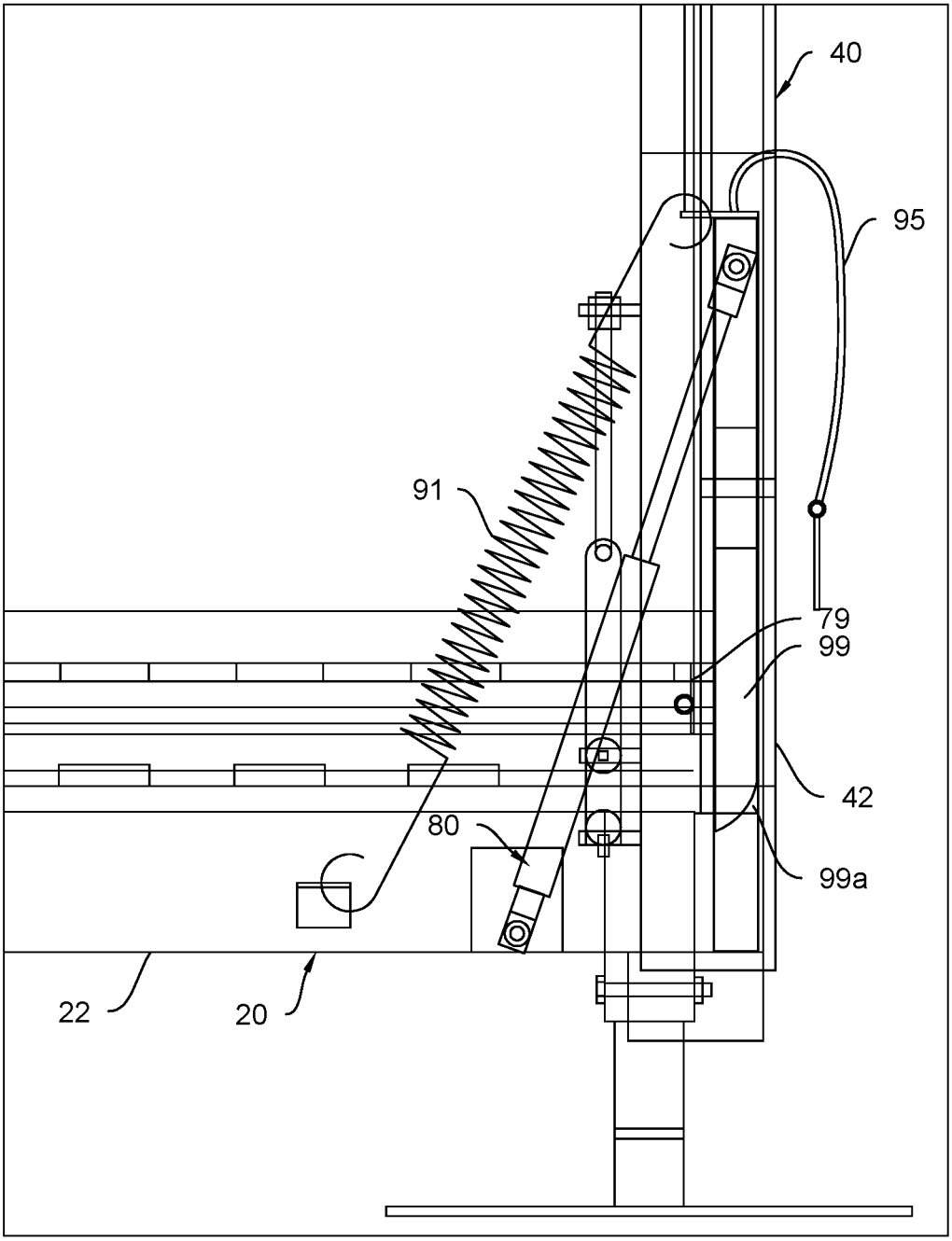
FIG. 10 shows an enlarged front see-through view of the right-bottom portion of the present invention 10 showing a securing member 99 in a secured position within the receiving portion 99*a*.
Figure 11:
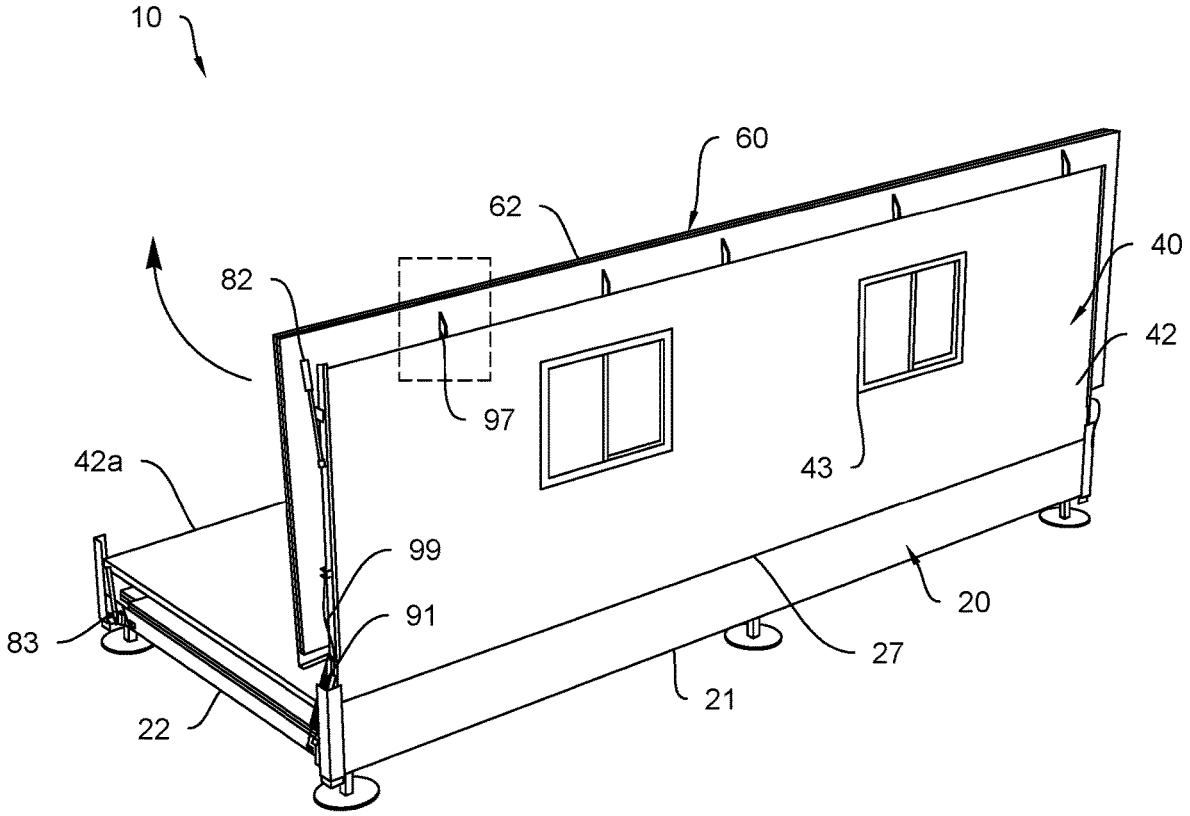
FIG. 11 is an illustration of an isometric view of the present invention 10 in the fourth step 204.
Figure 12:
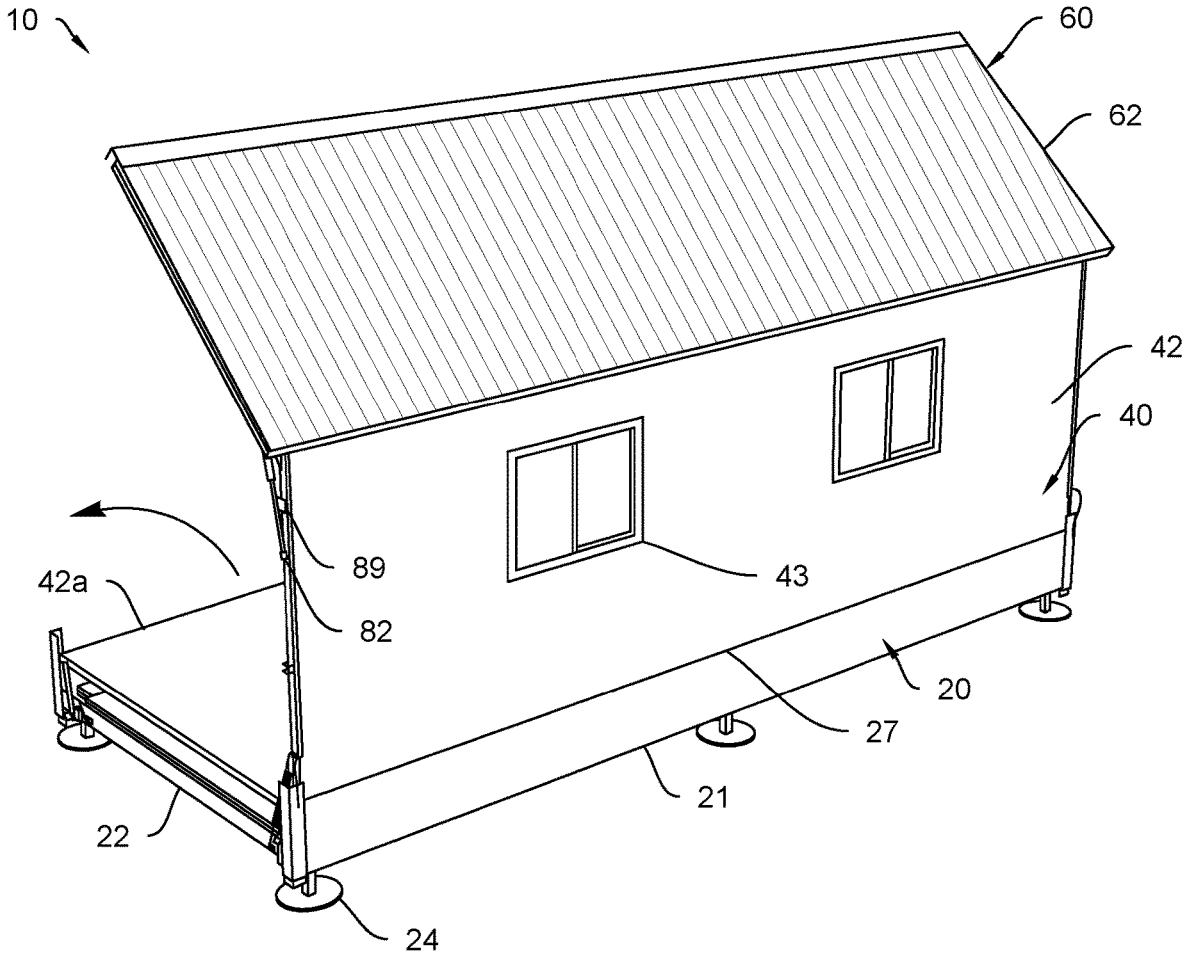
FIG. 12 is an illustration of an isometric view of the present invention 10 in the fifth step 205.
Figure 13:
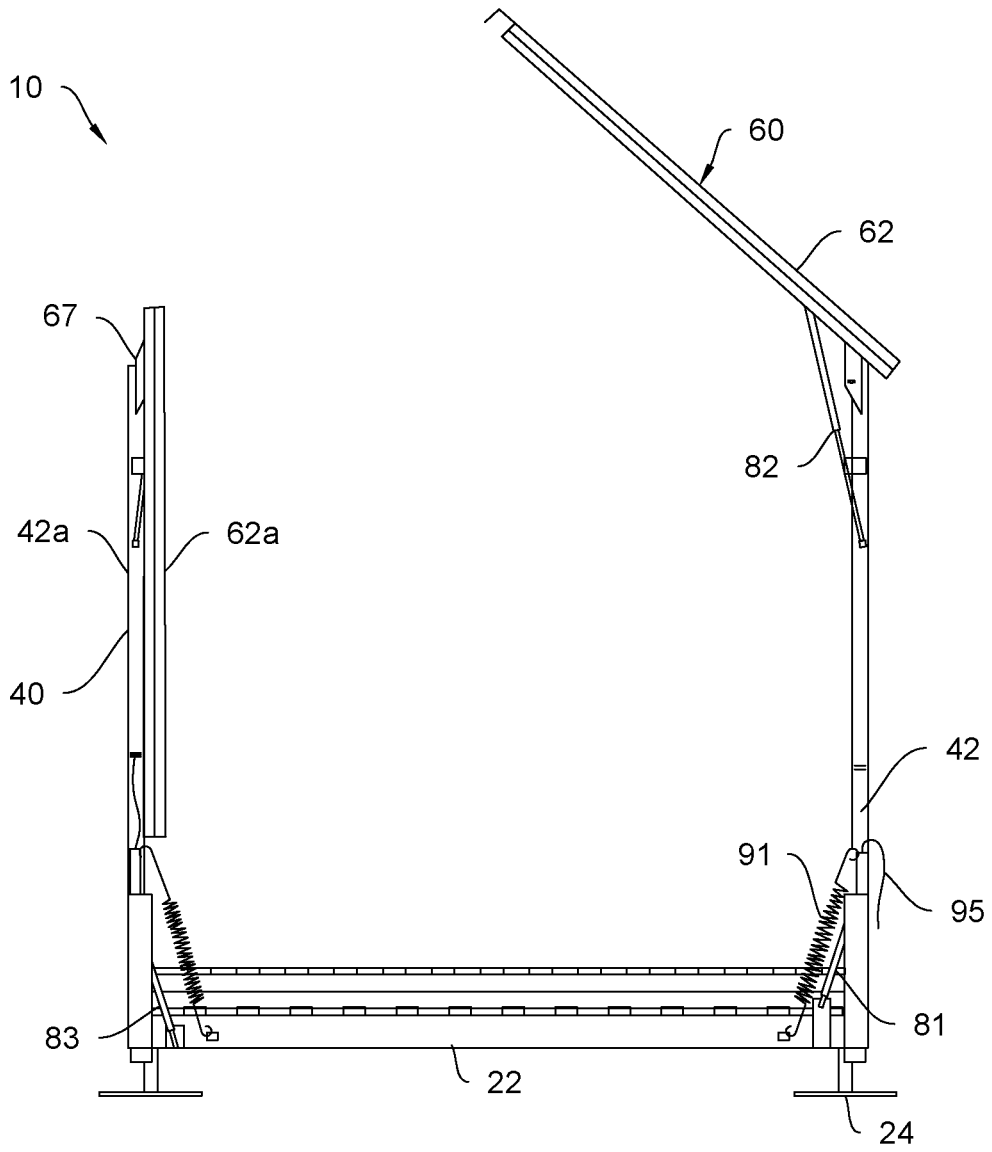
FIG. 13 is an illustration of a front view of the present invention 10 in the sixth step 206.
Figure 14:
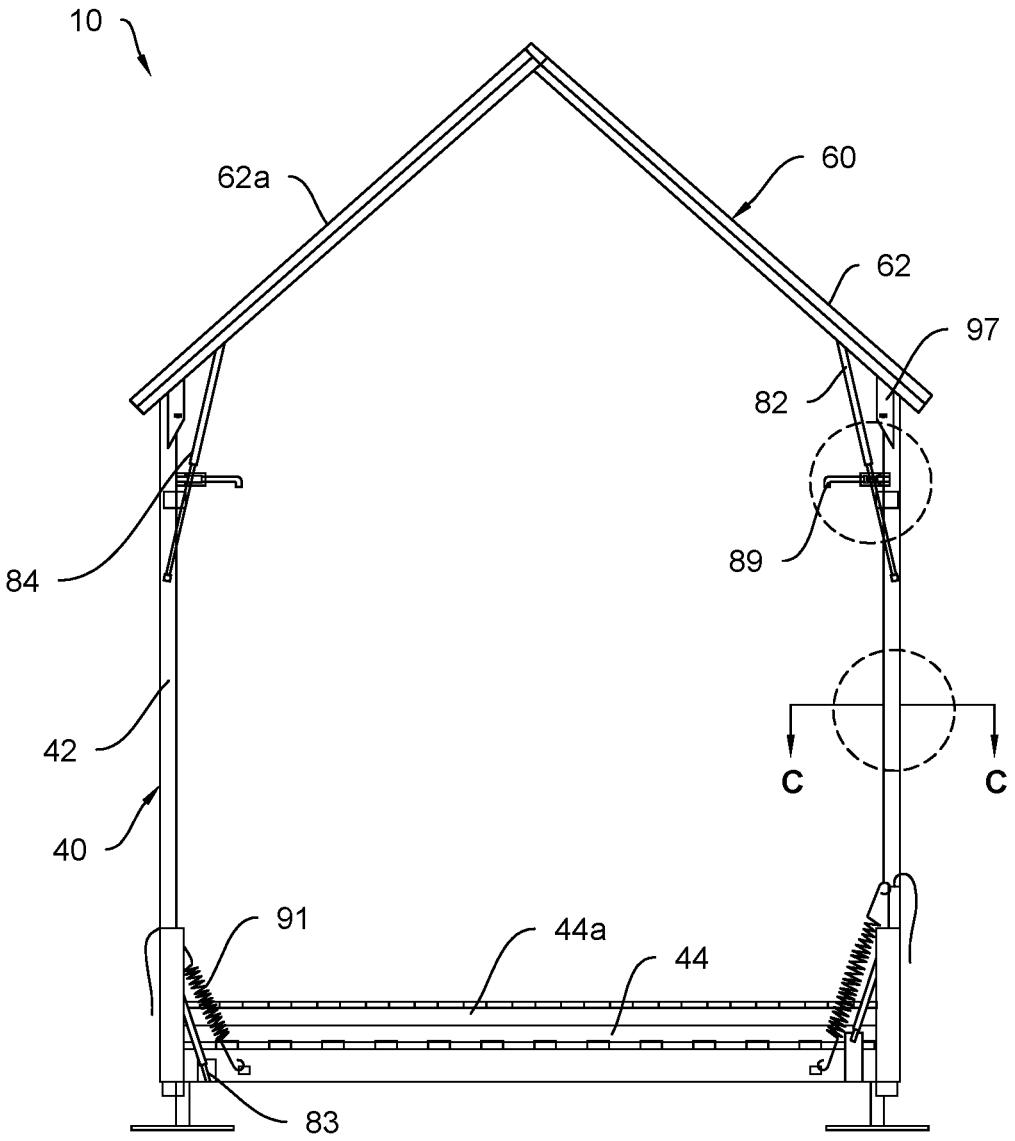
FIG. 14 shows a front see-through view of the present invention 10 in the seventh step 207.
Figure 15:
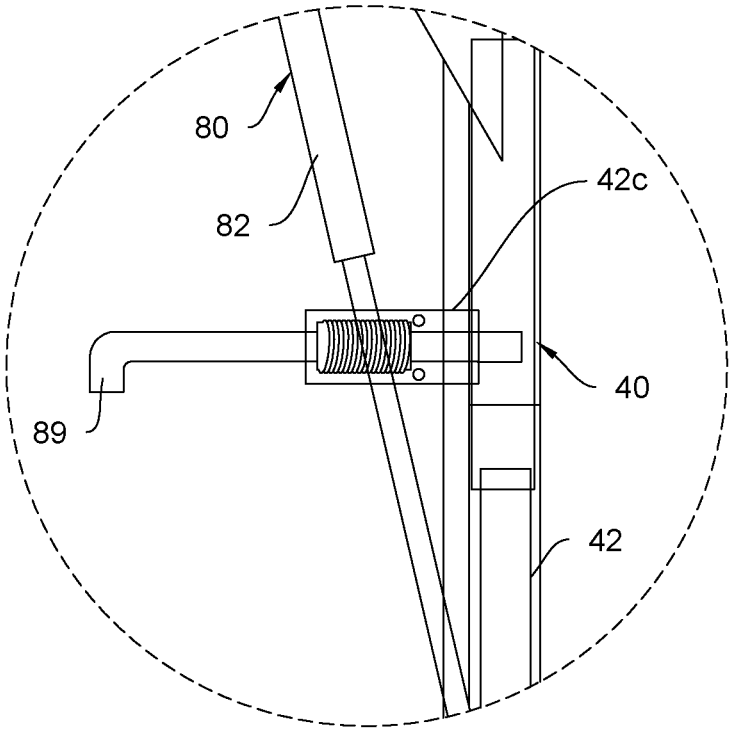
FIG. 15 represents an enlarged see-through view of the spring loaded latch 89.
Figure 16:
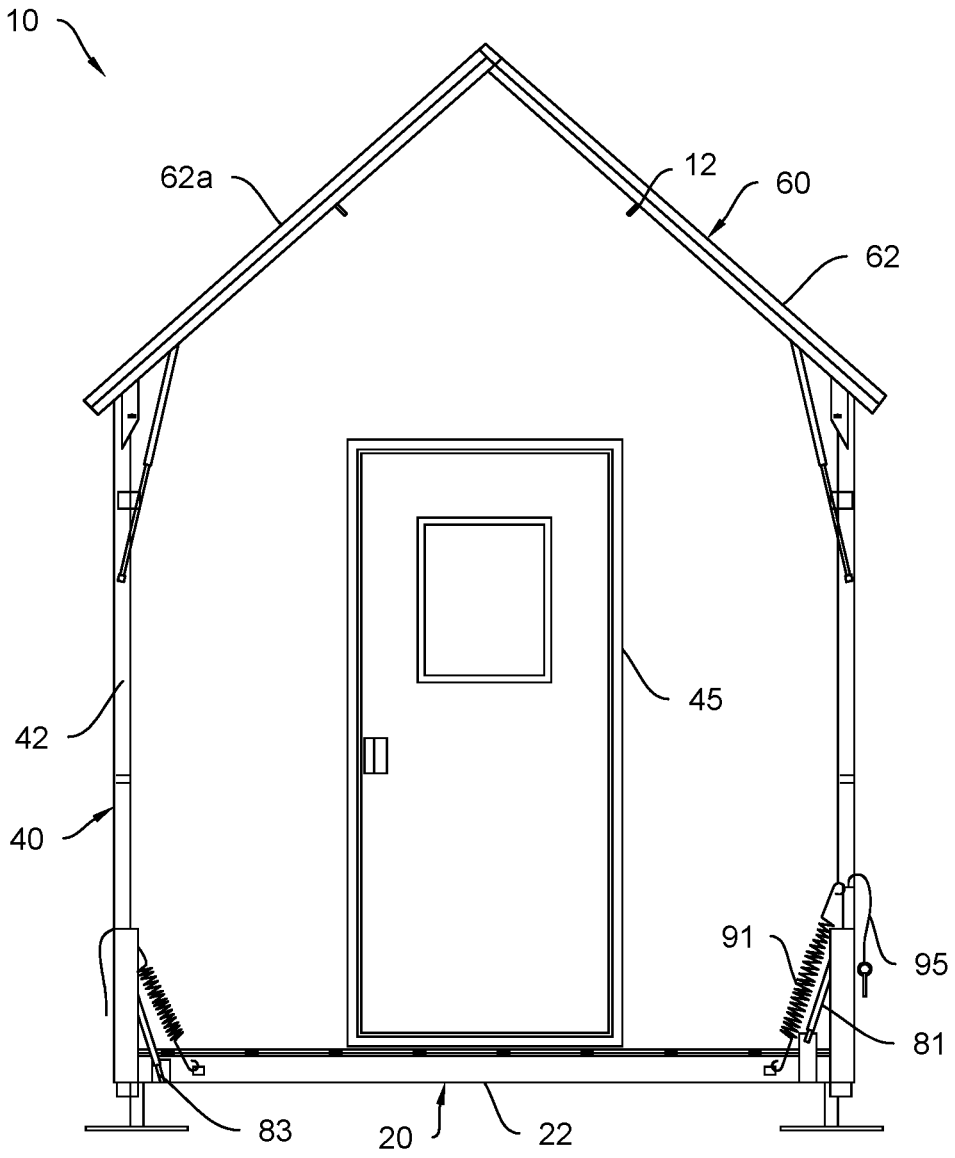
FIG. 16 illustrates a front view of the present invention 10 in the eight step 208.

Referring now to FIG. 9 and FIG. 10 it can be observed that springs 91 connect the base 22 with the securing members 99. The securing members 99 are within the left wall 42*a* and the right wall 42. It also may be suitable for the securing members 99 to be within the front wall 44 and the rear wall 44*a*. The securing members 99 may have the actuation members 95 attached thereto. As best illustrated in FIG. 9 the first gas springs 81 or the third gas springs 83 may be actuated to lift the left wall 42*a* or the right wall 42 at the time that the springs 91 are expanded. The springs 91 are operatively connected to the securing members 99. When the springs 91 are expanded the actuation members 95 are pulled forcing the actuation members 95 to release the securing members 99. The securing members 99 move down performing a movement C. Springs 91 are expanded when actuating the first gas spring 81, the third gas spring 83, or any other of the aforementioned gas springs are actuated. In a preferred embodiment the first gas spring 81 is operatively connected to the releasing member 102. As best illustrated in FIG. 1 the releasing member 102 may be pulled to actuate the first gas spring 81 to erect the right wall 42. The first gas spring 81, the second gas spring 82, the third gas spring 83, the fourth gas spring 84, the fifth gas spring 85 and the sixth gas spring 86 may be operatively connected therebetween to actuate the aforementioned gas springs in a consecutive order.

When pulled down, the securing members 99 are inserted into the receiving member 99*a* of the base 22. It should be understood that the receiving member of the base 22 may be formed by an opening along the sidewalls of the base 22. The securing members 99 may pull the actuation members 95. The actuation members 95 may release one of the gas springs 82 and 84 when pulled down. The first gas spring 81 may erect the right wall 42 when pulling the releasing member 102, then the spring 91 may force the securing member 99 to a secured configuration and pull down the actuation member 95 actuating the second gas spring 82, the second gas spring 82 may be operatively connected to the third gas spring 83, the third gas spring 83 may be actuated after the second gas spring 82 erects the right-side roof 62, and so on. In order to provide additional support for the lifting of the different walls referred in the present invention 10, the erecting members 79 may be actuated to expand along with the gas springs mentioned in the present invention to place the walls in an erected position. The erecting member 79 may be an industrial torsion spring. The erecting member 79 may be actuated to hold the walls of the present invention 10 in an erected configuration. The attaching members 12 may be used to fix the front wall 44 and the rear wall to the top walls. In a preferred embodiment the attaching members 12 are metal plates with openings receiving fasteners therethrough.

The spring loaded latches 89 may be located within a top portion of the front wall 44 and the rear wall 44*a*. The spring loaded latches 89 may be actuated to fit within the wall openings 42*c*. The wall openings 42*c* may be located on the right wall 42 and left wall 42*a*. The present invention 10 may further include openings to secure the roof assembly 60 to the wall assembly 40 by means of fasteners which in a preferred embodiment fasteners are butterfly screws. It should be understood that additional fasteners may be used to fix the present invention in an expanded or retracted configuration. As described above, the present invention 10 is a self-erective emergency shelter having gas springs connected therebetween to consecutively erect the different walls of the present invention.

Figure 7:
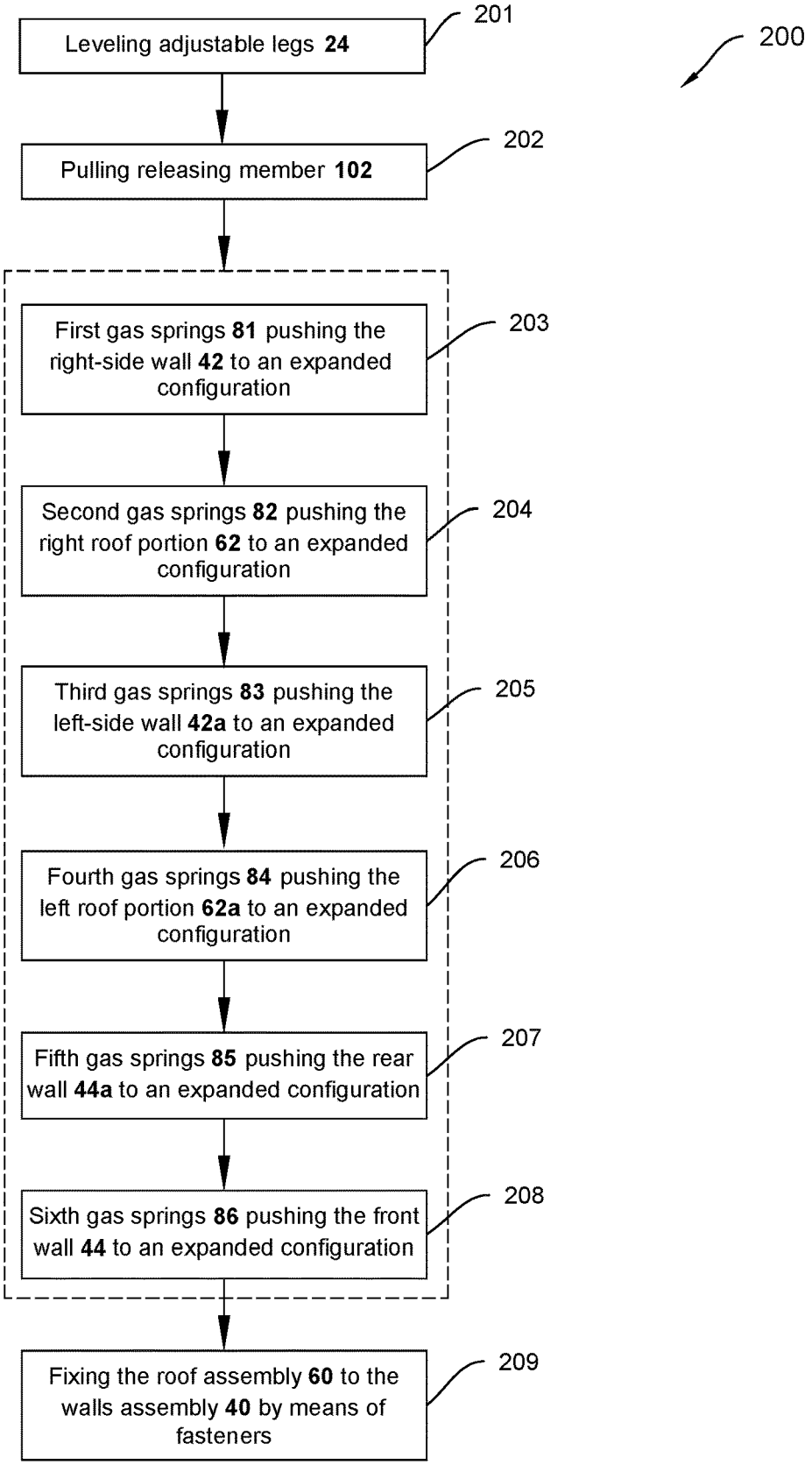
FIG. 7 shows a schematic view of releasing process 200. Releasing process 200 shows an order of releasing for the wall assembly 40.
Figure 8:
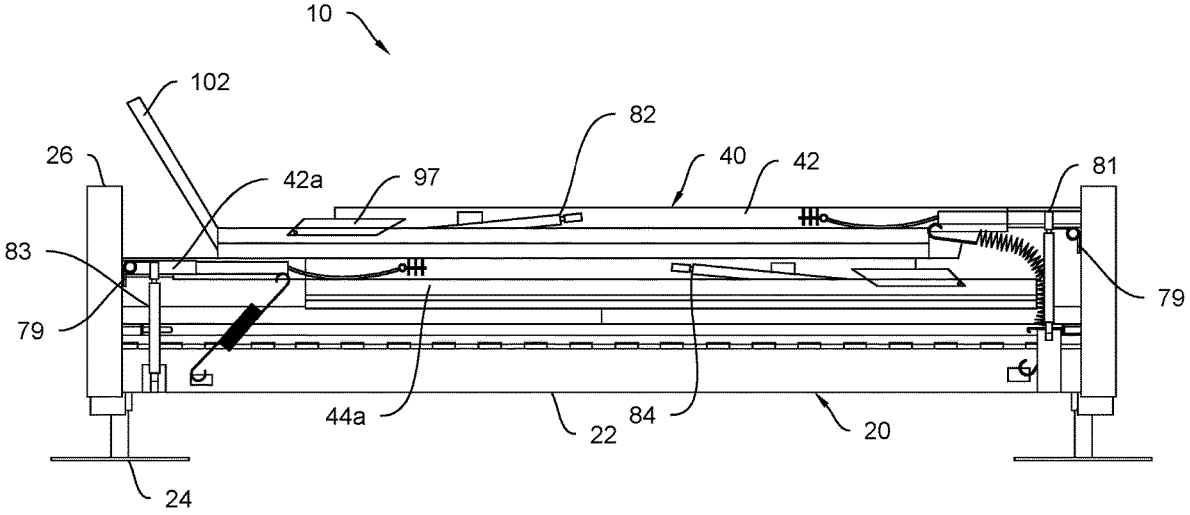
FIG. 8 represents a front see-through view of the present invention 10 in a retracted configuration.

Referring now to FIG. 7 it can be observed a method 200 including a first step 201, a second step 202, a third step 203, a fourth step 204, a fifth step 205, a sixth step 206, a seventh step 207, an eight step 208 and a ninth step 209. From the third step 203 to the eight step 208 are automated and consecutive steps performed by the present invention after pulling releasing member 102. The first step 201, the second step 202 and the ninth step 209 are performed by manipulating the present invention 10. The first step may include leveling the adjustable legs 24. The second step 202 may include pulling the releasing member 102. As mentioned before the releasing member 102 may be operatively connected to the first gas spring 81. The third step 203 may include the first gas springs 81 pushing the right-side wall 42 to an expanded configuration. The first gas spring 81 may be actuated when pulling the releasing member 102. The fourth step 204 may include the second gas springs 82 pushing the right roof portion 62 to an expanded configuration. The second gas springs 82 may be actuated after the right wall 42 is fixed and secured in an erected configuration. The right wall 42 may be fixed in an erected configuration by support of the first gas springs 81, by automatically placing the securing member 99 in a secured configuration. The fifth step 205 may be the third gas springs 84 pushing the left-side wall 42*a* to an expanded configuration. The third gas springs 84 may be operatively connected to the second gas springs 82. The sixth step 206 may include the fourth gas springs 84 pushing the left roof portion 62*a* to an expanded configuration. The fourth gas springs 84 may be operatively connected to the third gas springs 83. The seventh step 207 may include fifth gas springs 85 pushing the rear wall 44*a* to an expanded configuration. The fifth gas springs 85 may be operatively connected to the fourth gas springs 84. The eight step 208 may include sixth gas springs 86 pushing the front wall 44 to an expanded configuration. The sixth gas springs 86 may be operatively connected to the fifth gas springs 85. The eight step 208 may include fixing the roof assembly 60 to the wall assembly 40 by means of fasteners 94. It should be understood that in a preferred embodiment erecting of the present invention 10 is automated. It also may be suitable to manipulate the present invention to take the aforementioned walls to an expanded configuration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A self-erecting emergency shelter, comprising:

a base assembly, wherein said base assembly includes a base having height-adjustable legs;

a wall assembly, wherein said wall assembly includes a left wall, a right wall, a rear wall and a front wall pivotally attached to said base by means of piano hinges;

a roof assembly, wherein said roof assembly includes a roof pivotally attached to said left wall and said right wall; and a self-erecting assembly, wherein said self-erecting assembly includes a plurality of gas springs, wherein said plurality of gas springs are configured to be actuated to take said wall assembly and said roof assembly from a retracted configuration to an expanded configuration, wherein said left wall, right wall, rear wall, front wall, and roof are parallelly placed over said base in said retracted configuration, wherein said left wall, right wall, rear wall, front wall, and roof are erected defining an emergency shelter in said expanded configuration; wherein each said right wall and said left wall include a securing member therewithin, wherein said securing member is connected to said base by means of a spring, wherein said securing member is operatively connected to an actuation member, wherein said spring is expanded forcing said securing member to move down into a receiving member to fix said left wall or said right wall in an erected configuration, wherein said securing member is configured to actuate said actuation member, wherein said actuation member is configured to actuate a consecutive gas spring of the plurality of springs.

2. The self-erecting emergency shelter set forth in claim 1, wherein said roof includes a right-roof portion and a left-roof portion.

3. The self-erecting emergency shelter set forth in claim 2, wherein said plurality of gas springs includes first gas springs connecting a right portion of said base with a bottom portion of said right wall, second gas springs connecting a top portion of said right wall to a bottom portion of said right-roof portion, third gas springs connecting a left portion of the base with a bottom portion of said left wall, fourth gas springs connecting a top portion of said left wall with a bottom portion of said left-roof portion, fifth gas springs connecting a rear portion of the base with a bottom portion of the rear wall and sixth gas springs connecting a front portion of the base with a bottom portion of the front wall.

4. The self-erecting emergency shelter set forth in claim 3, wherein said first gas springs, said second gas springs, said third gas springs and said fourth gas springs are configured to be expanded placing said right wall and said left wall perpendicular to said base and said right-roof portion and said left-roof portion diagonally attached to said left wall and said right wall respectively defining an open gable roof, wherein said fifth gas springs and said sixth gas springs are configured to be expanded placing said rear wall and said front wall perpendicularly between said left wall and said right wall.

5. The self-erecting emergency shelter set forth in claim 1, wherein said front wall and said rear wall have a rectangular shape with a triangular-shaped top.

6. The self-erecting emergency shelter set forth in claim 1, wherein each of said front wall, said rear wall, said left wall and said right wall include an exterior layer, a frame, insulation and an interior layer, wherein said frame is made of structural rectangular pipes vertically and horizontally disposed defining a frame with opening therebetween, said frame provides structural support to said wall assembly, said frame supports said exterior layer and said interior layer, wherein said frame is enclosed within said exterior layer and said interior layer.

7. The self-erecting emergency shelter set forth in claim 6, wherein said structural rectangular pipes are made of iron or aluminum.

8. The self-erecting emergency shelter set forth in claim 6, wherein said insulation is expanded polystyrene.

9. The self-erecting emergency shelter set forth in claim 6, wherein said exterior layer is made of rectangular fiberglass plates.

10. The self-erecting emergency shelter set forth in claim 6, wherein said interior layer is made of plywood.

11. The self-erecting emergency shelter set forth in claim 1, wherein said base includes a base frame enclosed within a top layer and a bottom layer, wherein said top layer and said bottom layer are made of plywood having a polyvinyl chloride coat, wherein said base frame supports said bottom layer and said top layer.

12. The self-erecting emergency shelter set forth in claim 1, wherein said height-adjustable legs include a top member and a bottom member, wherein said bottom member includes first openings and said top member a top opening, wherein said top member is capable of receive said bottom member therein, wherein one of said first openings is aligned with said top opening to fix said bottom member with said top member by means of fasteners.

13. The self-erecting emergency shelter set forth in claim 1, wherein said front wall and said rear wall include spring loaded latches on lateral-top portions thereof, wherein said spring loaded latches are configured to be actuated to be fitted within wall openings of said left wall and said right wall to fix the front wall and the rear wall to the right wall and the left wall.

14. The self-erecting emergency shelter set forth in claim 1, wherein said front wall includes a door, wherein said left wall or said right wall include at least one window.

15. A self-erecting emergency shelter, comprising:

a base assembly, wherein said base assembly includes a base having height-adjustable legs;

a wall assembly, wherein said wall assembly includes a left wall, a right wall, a rear wall and a front wall pivotally attached to said base by means of piano hinges, wherein each of said front wall, said rear wall, said left wall and said right wall include an exterior layer, a frame, insulation and an interior layer, wherein said frame is made of structural rectangular pipes vertically and horizontally disposed defining a frame with spaces therebetween, said frame provides structural support to said wall assembly, said frame supports said exterior layer and said interior layer, wherein said frame is enclosed within said exterior layer and said interior layer;

a roof assembly, wherein said roof assembly includes a roof pivotally attached to said left wall and said right wall, wherein said roof includes a right-roof portion and a left-roof portion; and a self-erecting assembly, wherein said self-erecting assembly includes a plurality of gas springs and a releasing member, wherein said plurality of gas springs are configured to be consecutively actuated to take said wall assembly and said roof assembly from a retracted configuration to an expanded configuration by pulling said releasing member, wherein said left wall, right wall, rear wall, front wall, and roof are parallelly placed over said base in said retracted configuration, wherein said plurality of gas springs includes first gas springs connecting a right portion of said base with a bottom portion of said right wall, second gas springs connecting a top portion of said right wall to a bottom portion of said right-roof portion, third gas springs connecting a left portion of the base with a bottom portion of said left wall, fourth gas springs connecting a top portion of said left wall with a bottom portion of said left-roof portion, sixth gas springs connecting a front portion of the base with a bottom portion of the front wall, and fifth gas springs connecting a rear portion of the base with a bottom portion of the rear wall, wherein said first gas spring, said second gas springs, said third gas springs and said fourth gas springs are configured to be expanded placing said right wall and said left wall perpendicular to said base and said right-roof portion and said left-roof portion diagonally attached to said left wall and said right wall respectively defining an open gable roof, wherein said fifth gas springs and said sixth gas springs are configured to be retracted placing said front wall and said rear wall perpendicularly between said left wall and said right wall, wherein a distal end of said left-roof portion is coupled with a distal end of said right-roof portion in said expanded configuration; wherein wherein each said right wall and said left wall include a securing member therewithin, wherein said securing member is connected to said base by means of a spring, wherein said securing member is operatively connected to an actuation member, wherein said spring is expanded forcing said securing member to move down into a receiving member to fix said left wall or said right wall in an erected configuration, wherein said securing member is configured to actuate said actuation member, wherein said actuation member is configured to actuate a consecutive gas spring of the plurality of springs.

16. A self-erecting emergency shelter, consisting of:

a base assembly, wherein said base assembly includes a base having height-adjustable legs, wherein said base includes a base frame enclosed within a top layer and a bottom layer, wherein said top layer and said bottom layer are made of plywood having a polyvinyl chloride coat, wherein said base frame supports said bottom layer and said top layer, wherein said height-adjustable legs include a top member and a bottom member, wherein said bottom member includes first openings and said top member a top opening, wherein said top member is capable of receive said bottom member therein, wherein one of said first openings is aligned with said top opening to fix said bottom member with said top member by means of fasteners;

a wall assembly, wherein said wall assembly includes a left wall, a right wall, a rear wall and a front wall pivotally attached to said base by means of piano hinges, wherein said front wall and said rear wall have a rectangular shape with a triangular-shaped top, wherein each of said front wall, said rear wall, said left wall and said right wall include an exterior layer, a frame, insulation and an interior layer, wherein said frame is made of structural rectangular pipes vertically and horizontally disposed defining a frame with spaces therebetween, said frame provides structural support to said wall assembly, said frame supports said exterior layer and said interior layer, wherein said frame is enclosed within said exterior layer and said interior layer, wherein said structural rectangular pipes are made of iron or aluminum, wherein said insulation is expanded polystyrene, said exterior layer is made of rectangular fiberglass plates and said interior layer is made of plywood;

a roof assembly, wherein said roof assembly includes a roof pivotally attached to said left wall and said right wall, wherein said roof includes a right-roof portion and a left-roof portion; and a self-erecting assembly, wherein said self-erecting assembly includes a plurality of gas springs and a releasing member, wherein said plurality of gas springs are configured to be consecutively actuated to take said wall assembly and said roof assembly from a retracted configuration to an expanded configuration by pulling said releasing member, wherein said left wall, right wall, rear wall, front wall, and roof are parallelly placed over said base in said retracted configuration, wherein said plurality of gas springs includes first gas springs connecting a right portion of said base with a bottom portion of said right wall, second gas springs connecting a top portion of said right wall to a bottom portion of said right-roof portion, third gas springs connecting a left portion of the base with a bottom portion of said left wall, fourth gas springs connecting a top portion of said left wall with a bottom portion of said left-roof portion, fifth gas springs connecting a rear portion of the base with a bottom portion of the rear wall and sixth gas springs connecting a front portion of the base with a bottom portion of the front wall, wherein said first gas spring, said second gas springs, said third gas springs and said fourth gas springs are configured to be expanded placing said right wall and said left wall perpendicular to said base and said right-roof portion and said left-roof portion diagonally attached to said left wall and said right wall respectively defining an open gable roof, wherein said fifth gas springs and said sixth gas springs are configured to be retracted placing said front wall and said rear wall perpendicularly between said left wall and said right wall, wherein a distal end of said left-roof portion is coupled with a distal end of said right-roof portion in said expanded configuration, wherein each said right wall and said left wall include a securing member therewithin, wherein said securing member is connected to said base by means of a spring, wherein said securing member is operatively connected to an actuation member, wherein said spring is expanded forcing said securing member to move down into a base opening to fix said left wall or said right wall in an erected configuration, wherein said securing member actuates said actuation member to actuate a consecutive gas spring of the plurality of springs.

* * * * *